US009368916B2

(12) United States Patent
Heyvaert et al.

(10) Patent No.: US 9,368,916 B2
(45) Date of Patent: Jun. 14, 2016

(54) CROSS TALK REDUCTION FOR ELECTRICAL CONNECTORS

(75) Inventors: Winnie Heyvaert, Brasschaat (BE); Ludwig Lange, Nuland (NL); Thierry Goossens, Herdersem-Aalst (NL); Jeroen De Bruijn, Loon Op Zand (NL)

(73) Assignee: FCI Asia PTE, Ltd., Singapore (SG)

( * ) Notice: Subject to any disclaimer, the term of this patent is extended or adjusted under 35 U.S.C. 154(b) by 71 days.

(21) Appl. No.: 14/122,705

(22) PCT Filed: May 25, 2012

(86) PCT No.: PCT/IB2012/001315

§ 371 (c)(1),
(2), (4) Date: Jan. 21, 2014

(87) PCT Pub. No.: WO2012/164399

PCT Pub. Date: Dec. 6, 2012

(65) Prior Publication Data

US 2014/0127919 A1 May 8, 2014

(30) Foreign Application Priority Data

May 27, 2011 (WO) ..... PCT/IB2011/001589

(51) Int. Cl.

| | |
|---|---|
| ***H01R 13/6471*** | (2011.01) |
| ***H01R 13/6461*** | (2011.01) |
| *H01R 13/7197* | (2011.01) |
| *H01R 12/50* | (2011.01) |
| *H01R 13/66* | (2006.01) |

(52) U.S. Cl.

CPC ..... *H01R 13/6471* (2013.01); *H01R 13/6461* (2013.01); *H01R 13/6658* (2013.01); *H01R 13/7197* (2013.01); *H01R 23/688* (2013.01); *H01R 23/6873* (2013.01); *H01R 23/7073* (2013.01)

(58) Field of Classification Search

CPC ..... H01R 23/688; H01R 13/7197; H01R 23/6873; H01R 23/7073; H01R 13/6658

USPC ..... 439/608, 607.05, 607.06, 607.07, 439/607.08, 607.09, 607.1, 607.11, 607.12, 439/607.13, 79, 76.1

See application file for complete search history.

(56) References Cited

U.S. PATENT DOCUMENTS

| | | | | |
|---|---|---|---|---|
| 2003/0181077 | A1* | 9/2003 | Rothermel | H01R 13/6586 439/76.1 |
| 2009/0156027 | A1 | 6/2009 | Chen | 439/83 |
| 2009/0170373 | A1 | 7/2009 | Pan | 439/607.36 |
| 2009/0221165 | A1* | 9/2009 | Buck | H01R 13/514 439/108 |

* cited by examiner

*Primary Examiner* — Abdullah Riyami
*Assistant Examiner* — Justin Kratt
(74) *Attorney, Agent, or Firm* — Harrington & Smith

(57) ABSTRACT

An electrical connector module including a housing and an array of electrical contacts within the housing. The electrical contacts include a plurality of signal conductors and a plurality of ground conductors. Ground coupling bars are used with at least two contact portions for contacting ground conductors. The connector includes slots enabling insertion of the ground coupling bar in a longitudinal direction of the ground coupling bar.

15 Claims, 7 Drawing Sheets

4
2
3
10
14
13
15
16
17
18
19
20
11
27
28
21
12

CROSS TALK REDUCTION FOR ELECTRICAL CONNECTORS

FIELD OF THE DISCLOSURE

In general, the invention relates to the field of electrical connectors, in particular to a high speed electrical connector comprising an insulating housing and a plurality of electrical conductors.

BACKGROUND OF THE DISCLOSURE

Electrical connectors provide signal connections between electronic devices using signal conductors. Often, the signal conductors are so closely spaced that undesirable interference, or "cross talk", occurs between adjacent signal conductors. Cross talk occurs when a signal in one signal conductor induces electrical interference in an adjacent signal conductor due to interfering electrical fields, thereby compromising signal integrity. Cross talk may also occur between differential signal pairs. Cross talk increases with reduced distance between the interfering signal conductors. Cross talk may be reduced by separating adjacent signal conductors or adjacent differential signal pairs with ground conductors.

With electronic device miniaturization and high speed signal transmission, high signal integrity electronic communications and the reduction of cross talk become a significant factor in connector design. It is desired to provide an improved connector reducing the problematic occurrence of cross talk, especially for high speed connectors. It is further desired to provide a connector allowing easy assembly and customizing of grounding provisions.

SUMMARY OF THE DISCLOSURE

In an aspect of the invention an electrical connector assembly is provided, comprising a housing and a plurality of electrical conductors within the housing. The electrical conductors include a plurality of signal conductors and a plurality of ground conductors. The housing comprises at least one slot enabling insertion of a ground coupling bar from outside in a longitudinal direction of the ground coupling bar. The at least one slot is positioned adjacent a line, e.g., a column or a row, of conductors including ground conductors. The ground coupling bar comprises contact portions for contacting the ground conductors when inserted in the slot.

This way the frequency of a cross talk resonance may be shifted by establishing an additional contact to ground for the ground conductors. Since the ground bar can be inserted in its longitudinal direction from outside, it is possible to provide a slot which is easily accessible for placing, removing or rearranging ground coupling bars. The ground coupling bar can selectively be placed or removed during or after assembly of the connector. The arrangement of ground contacts and signal contacts can be customized by a user by selectively positioning ground coupling bars in selected slots.

A connector according to claim 3 and/or 4 achieves better contact between the ground coupling bar and the ground conductors.

The slot can be positioned between two lines of conductors, wherein the conductors of at least one of the two lines comprise ground conductors configured to contact the ground coupling bar when inserted in the slot. In such a case, a connector according to claim 4 or 5 can be used. Ground conductors of two adjacent columns or rows of ground conductors can be contacted by the same ground coupling bar.

With the connector of claim 6 a shouldered top end forms a stop for the ground coupling bar.

With the connector of claim 7 erratic positioning of the ground coupling bar can effectively be prevented. The polarization features can for instance include a matching asymmetrical configuration of the shouldered top end and the slot in the housing.

With a connector according to claim 8 or 9, a connector is provided comprising a plurality of subassemblies or modules adapted for connection to a contact panel having a ground conductor. The modules can for instance be planar and be arranged substantially parallel and in side by side relationship and comprise a module housing and a plurality of signal conductors and/or ground conductors. At least a portion of the conductors can be arranged in the module housing, e.g., in a plurality of pairs for differential signal transmission and a plurality of ground conductors separating different pairs.

Such a connector accommodates a relatively large number of mutually adjacent differential signal pairs with reduced cross talk at one or more predetermined signal frequencies.

Thus, a connector is provided which allows a relatively large number of differential signal pairs, while cross talk between adjacent differential signal pairs may be substantially reduced.

The contact ends of such a connector may include a mounting end, e.g., for mounting on a circuit board, and/or a mating end, e.g., for cooperation with a matching counterconnector.

With the connector of claim 10 or 11 a direct contact can be established between the ground coupling bars and the ground shield.

In a connector of claim 12, the ground coupling bars are fixated after insertion by the resilient members of the ground shield.

With the connector of claim 13 the resilient blades of the ground shield contribute to the shielding at the location of the openings in the ground shield.

In a further aspect a ground coupling bar is disclosed, which can for instance be or comprise a metal sheet part.

In a further aspect a tool is provided according to claim 14. This tool can be used to push one or more ground coupling bars out of the connector, e.g., against the action of resilient members of the ground shield engaging the top ends of the ground coupling bars. Such a tool is particularly useful for connectors having ground coupling bar receiving slots which are accessible from outside from opposite ends.

In another aspect, a method is provided for assembling a connector comprising a plurality of conductors, including a plurality of signal conductors and a plurality of ground conductors. The conductors are arranged in modules, e.g. planar modules, carrying one or more lines of conductors having contacting ends and a lead frame portion extending between the contacting ends. The modules are arranged within a housing, wherein recesses in adjacent modules jointly define a ground coupling bar receiving slot, which is in line with an opening in the housing. In the recesses the conductors are at least partly uncovered. Subsequently a ground coupling bar is inserted into the ground coupling bar receiving slot via the corresponding opening in the housing. The ground coupling bar is configured to contact one or more of the uncovered parts of the conductors. With such an assembly method the ground coupling bar locks the modules within the housing.

BRIEF DESCRIPTION OF THE DRAWINGS

The drawings show embodiments of a connector and connector modules by way of example, the drawings being explained in more detail below. In the drawings.

DETAILED DESCRIPTION OF EMBODIMENTS

Figure 1A:
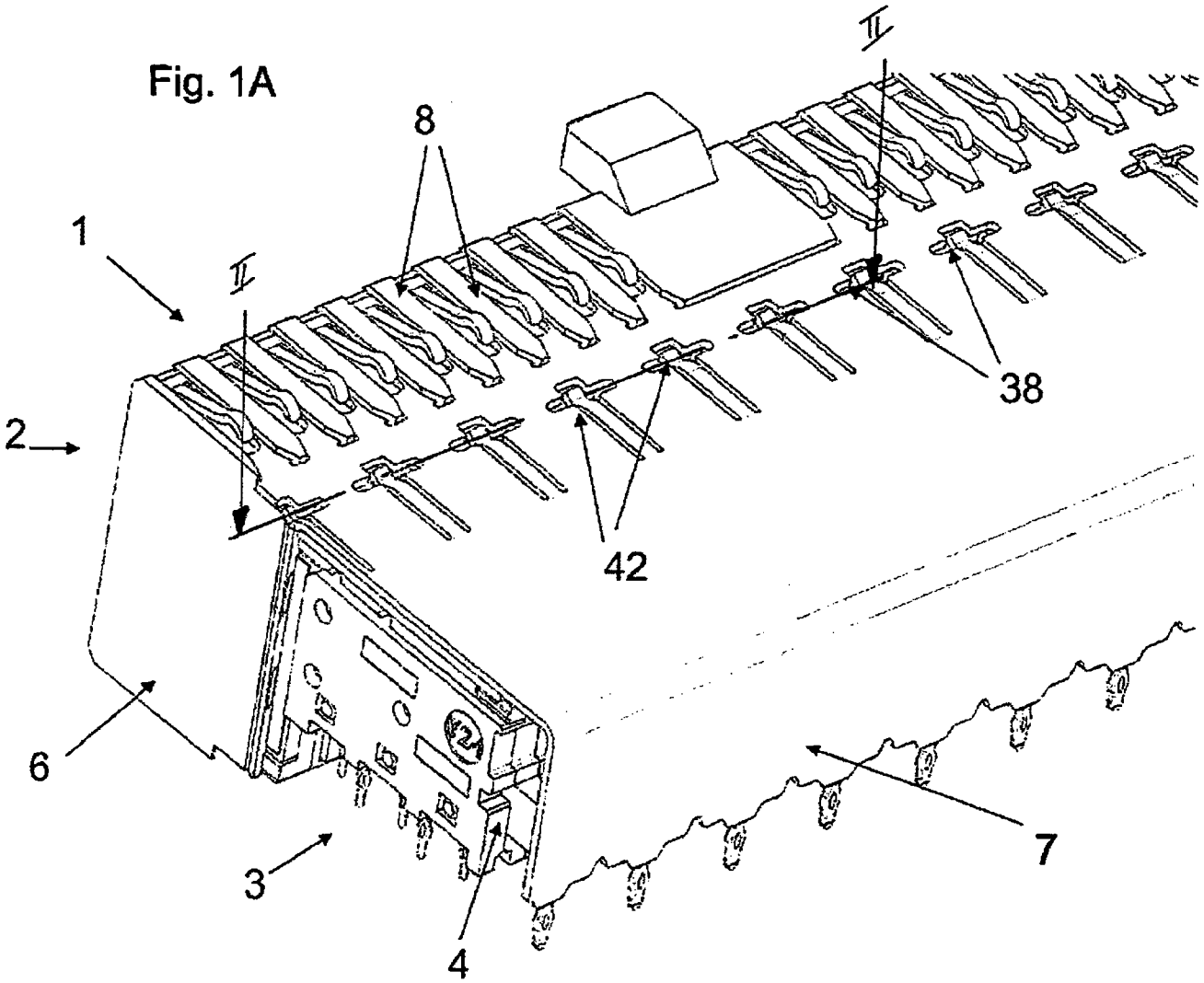
FIG. 1A shows an exemplary embodiment of a connector in perspective view.
Figure 1B:
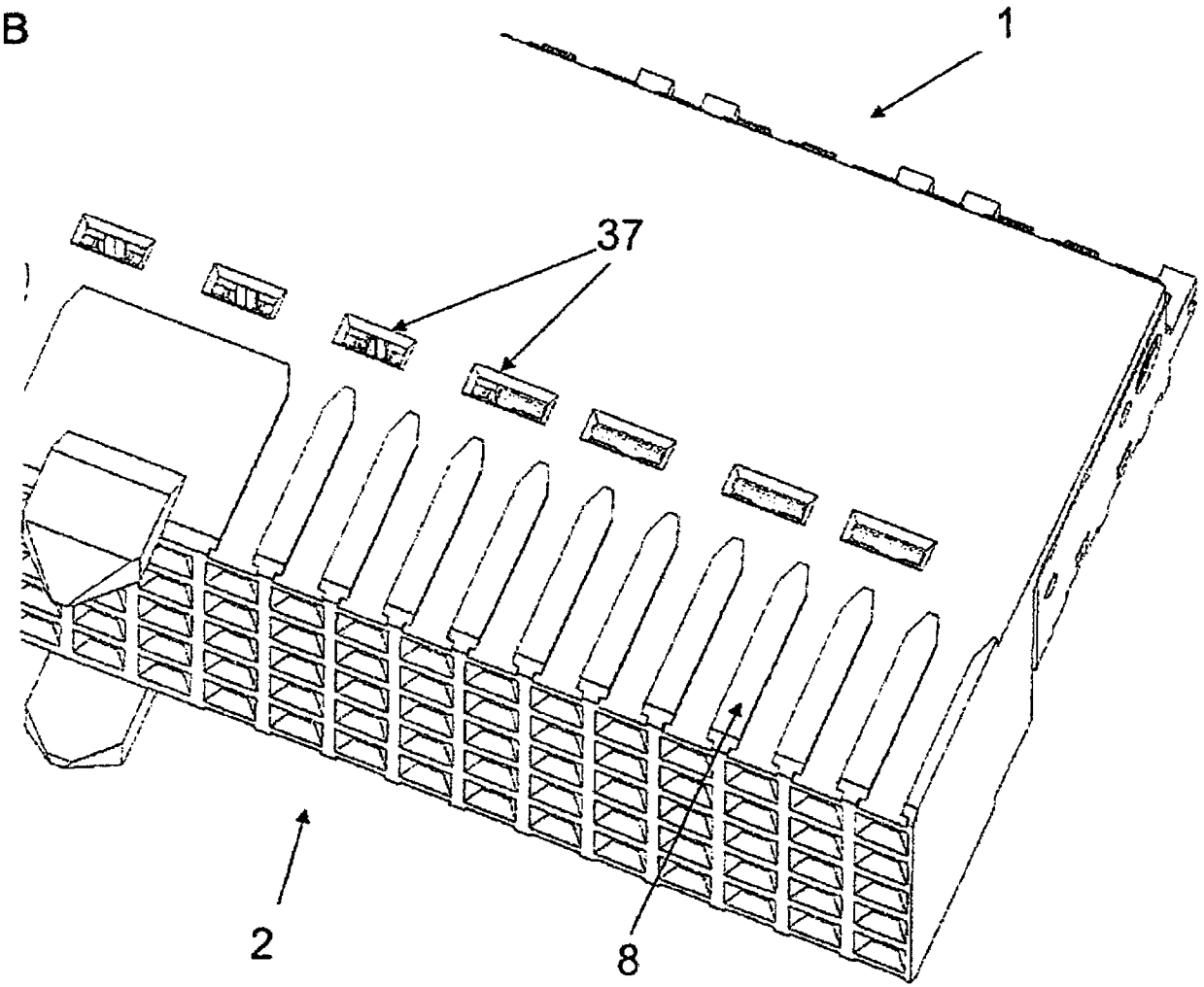
FIG. 1B shows the connector of FIG. 1B without ground shield.

FIGS. 1A and 1B show different perspective views of an exemplary right angle electrical receptacle connector 1 adapted to electrically connect one device to another device, such as printed circuit boards, electronic apparatus and/or cables, provided with a corresponding header (not shown). A suitable connector may take other forms such as a vertical or horizontal electrical connector or one connecting devices at different angles.

The shown receptacle connector 1 has a mating end 2, and a mounting end 3. The mating end 2 can for instance be configured to cooperate with a header. The mounting end 3 can for instance be configured to contact a panel or printed circuit board.

Figures 4A, 4B:
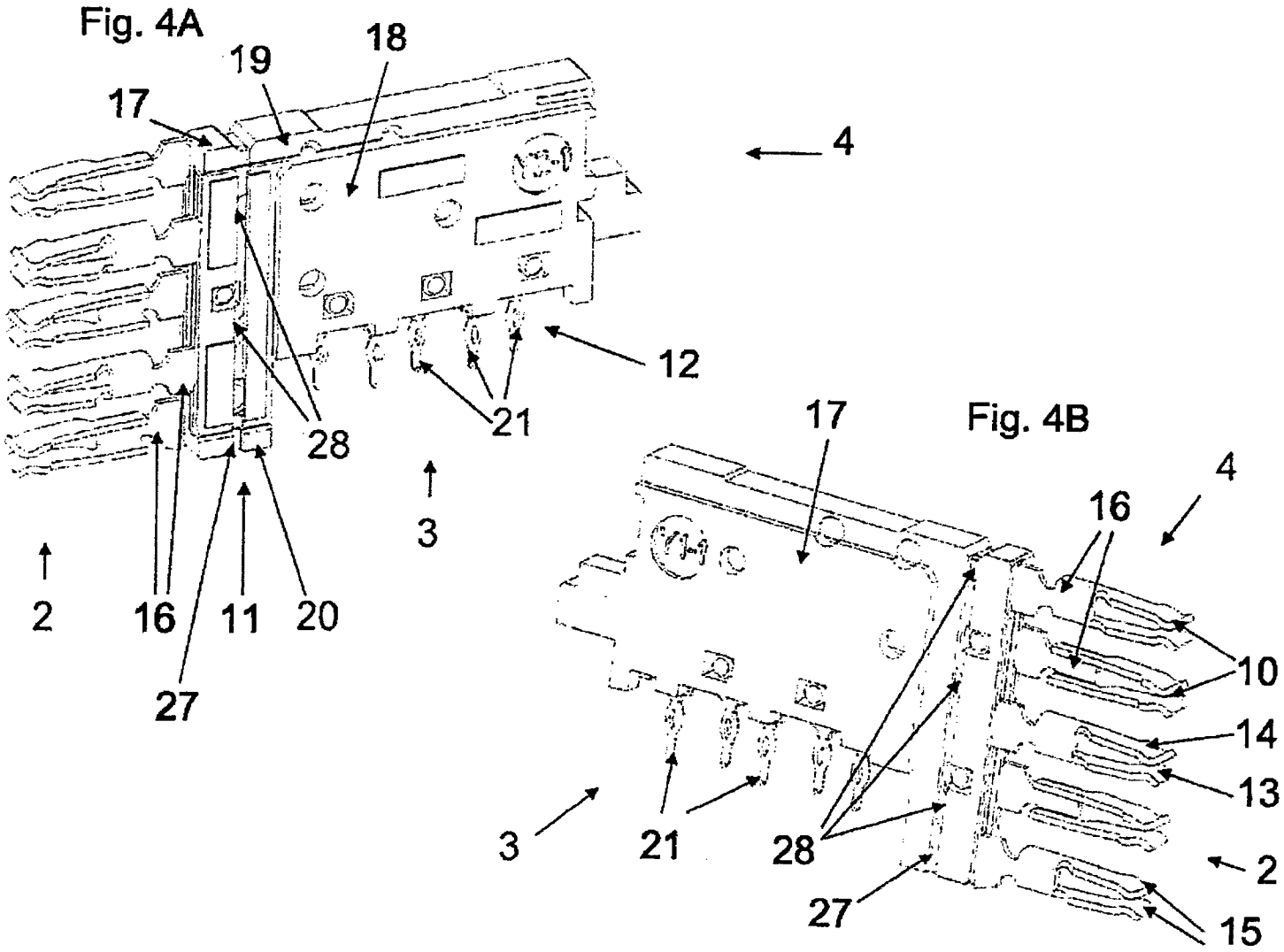
FIG. 4A and 4B show an exemplary embodiment of a subassembly of the connector of FIGS. 1A and 1B.

The connector 1 comprises a plurality of modules or subassemblies 4, shown in more detail in FIGS. 4A and 4B. The subassemblies 4 are retained in an insulating connector housing 6 covered with a ground shield 7 with clips 8 for engaging the ground shield of a mating header connector (not shown).

As shown in FIGS. 4A and 4B each subassembly 4 comprises a column of conductors 10 extending between the mating end 2 and the mounting end 3. At the mating end 2, the subassembly 4 comprises a front section 11 extending below a back section 12 of the subassembly 4. At the upper side the front and back sections 11, 12 are substantially flush.

At the mating end the conductors 10 comprise two opposite flexible beams 13, 14 projecting from the front section 11. The flexible beams 13, 14 provide a dual beam mating end for mechanically and electrically engaging the contacts of a mating header (not shown). The beams 13, 14 have free ends 15 curved towards each other to clamp the mating header contact (not shown). The other ends of the beams 13, 14 are spaced by a web portion 16.

Each subassembly 4 comprises a first and a second interconnected insert moulded lead frame assembly (IMLA) 17, 18. As is particularly shown in the cross section in FIG. 2, each first lead frame subassembly 17 comprises an upper rib 19 at its upper edge and a lower rib 20 at the lower edge of the front section 11. Each second lead frame assembly 18 is held between the ribs 19, 20 of the first lead frame assembly 17. In the exemplary embodiment of the drawings the first lead frame assembly 17 comprises a column of three conductors 10 having their web portion 16 at their left side. The second lead frame assembly 18 comprises a column of two conductors 10 having their web portion 16 at their right side. This way, the flexible beams 13, 14 held by the first lead frame assembly 17 are in line with the beams 13, 14 with the second lead frame assembly 18.

At the mounting end 3 the conductors 10 are provided with any suitable terminal for establishing an electrical and mechanical connection with an electrical device. In the shown exemplary embodiment, the terminals 21 include eye-of-the-needle press fit contacts for circuit board mounting. Alternatively, these terminals may comprise a solder ball soldered to a solder pad on the electrical device, or be configured to be inserted into a plated through-hole.

Figure 2:
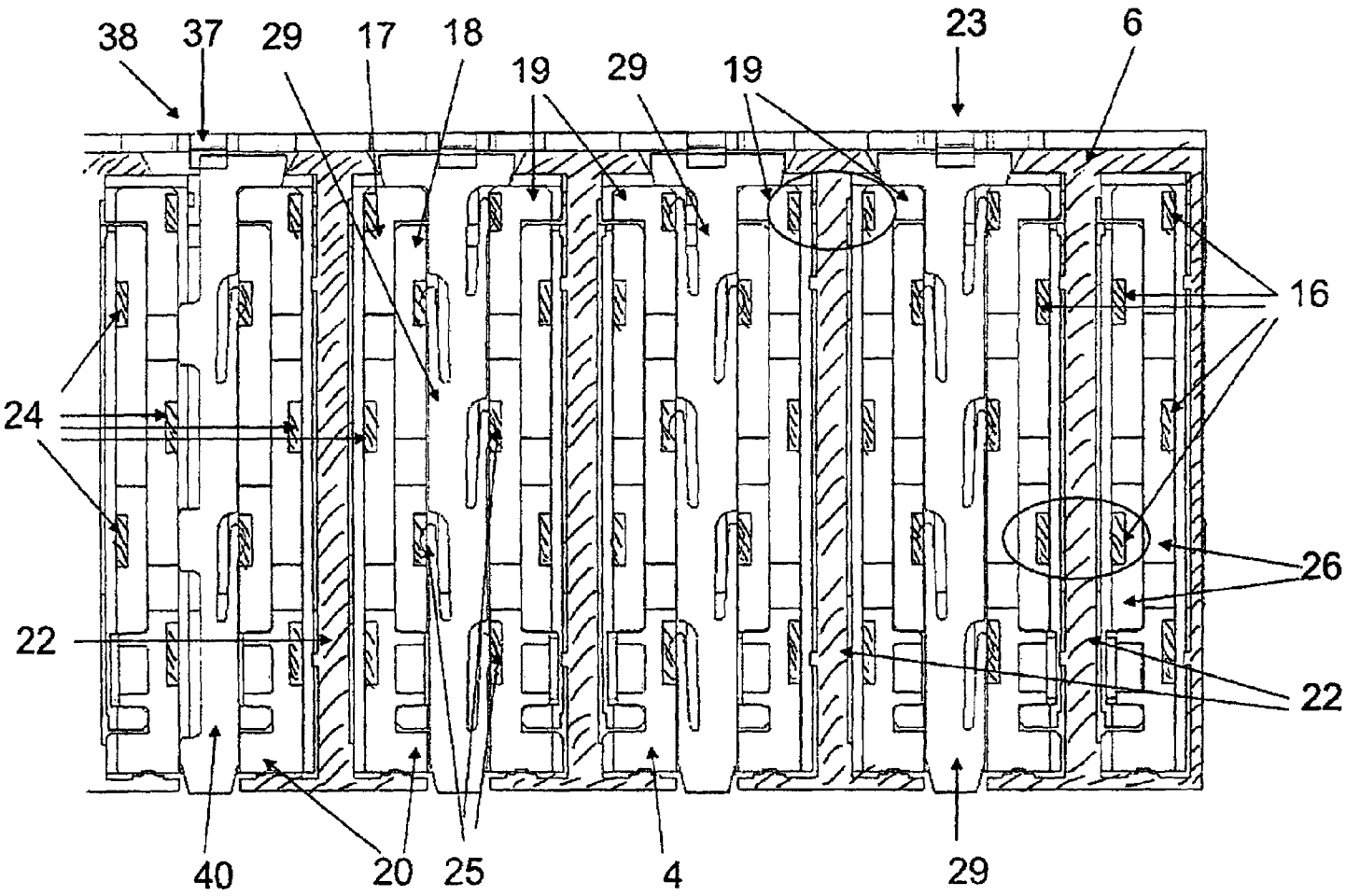
FIG. 2 shows a cross section of the connector along line II-II in FIGS. 1A and 1B.

FIG. 2 shows a cross section along line II-II in FIG. 1. The insulating connector housing 6 comprises partitions 22 partitioning the inner space of the housing 6 into cells 23, each cell 23 encasing two subassemblies 4. In each cell 23 the ribs 19, 20 of the first lead frame assemblies 17 point in the same direction, which is opposite to the pointing direction of the ribs 19, 20 of the first lead frame assemblies 17 in an adjacent cell 23. Conductors 10 arranged close to the partitions 22 of the cell 23 form signal conductors 24. Two signal conductors 24 at opposite sides of a partition form a differential pair (encircled in FIG. 2). Conductors 10 in the two middle columns in a cell 23 form ground conductors 25. Each differential pair of signal conductors 24 are flanked by ground conductors 25.

The conductors 10 in the lead frame assemblies 17, 18 are embedded in a casing 26 of an insulating material. The cross section of FIG. 2 shows the subassemblies 4 at a point where a recess 27 (see FIG. 4B) interrupts the insulating casing 26 uncovering lead portions 28 of the conductors 10.

Figure 3A:
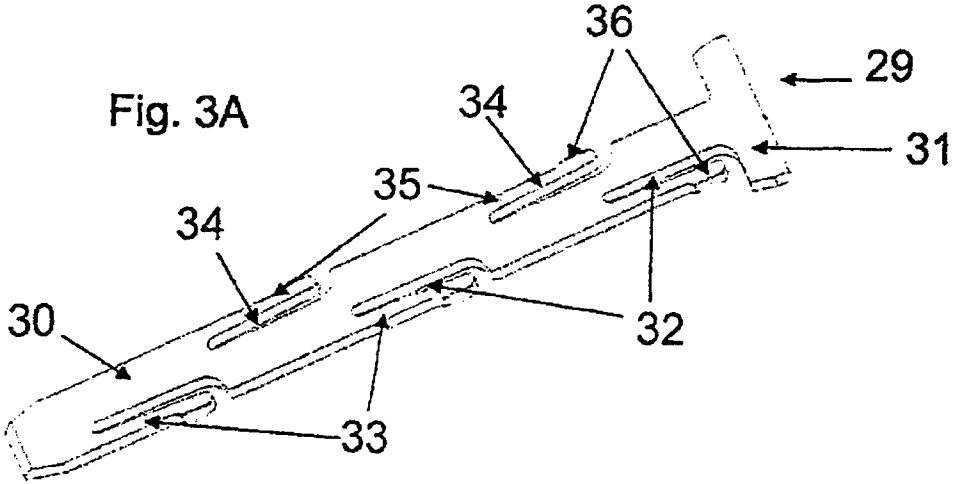
FIG. 3A shows a first exemplary embodiment of a ground coupling bar.

A T-shaped sheet metal ground coupling bar 29 is inserted between the two subassemblies 4 in each cell 23 via the recesses 27. FIG. 3A shows an exemplary embodiment of such a ground coupling bar 29. The ground coupling bar 29 comprises a longitudinal main body 30 with a broadened head 31 on its top end. The main body 30 comprises one side with three cut-outs 32 having an inverse J-shaped outline defining resilient fingers 33 which can be resiliently bent in a lateral direction. At the opposite side the main body 30 is provided with similar cut-outs 34 and resilient fingers 35, which are mirrored and arranged in a staggered manner relative to the cut-outs 32 and fingers 33 of the first side of the main body 30. To reduce the contact surface between the resilient fingers 35 and the ground conductors 25 the free ends of the resilient fingers 35 are provided with a flattened or coined bulged end 36.

The insulating housing 6 comprises openings 37 (see FIG. 2) allowing passage of the ground coupling bars 29. The ground shield 7 also comprises openings 38 in line with the openings 37 in the housing 6. The openings 37 in the housing 6 and the heads 31 of the ground coupling bars 29 are asymmetrically configured to form a polarized fit, so the heads 31 of the ground coupling bars 29 can only fit into the openings 37 in a single orientation. In this orientation the three fingers 33 at the first side of the ground coupling bar 29 engage the three lead portions 28 embedded in a first lead frame assembly 17, while the free ends 36 of the two fingers 35 at the opposite side of the ground coupling bar 29 engage the two lead portions 28 in a second lead frame assembly 18. This way, the ground coupling bar 29 connects the ground conductors.

Figure 3B:
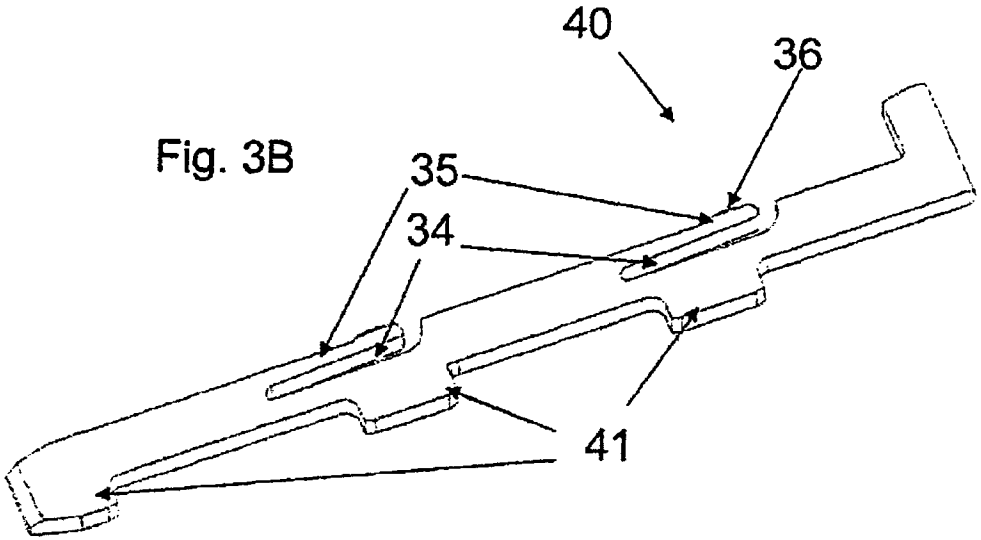
FIG. 3B shows a second exemplary embodiment of a ground coupling bar.

A second example of a ground coupling bar is shown in FIG. 3B. This ground coupling bar 40 has only one side with two inverse J-shaped cut outs 34 and fingers 35. At the opposite side, the ground coupling bar 40 is provided with two spacers 41. These spacers 41 are positioned in such a way that they contact the adjacent second lead frame assembly 18 at a position centrally between two conductors 10.

The ground shield 7 covering the insulating housing 6 of the connector 1 is provided with resilient contacting blades 42 positioned to engage the heads 31 of the ground coupling bars 29, 40. The heads 31 abut the top surface of the ribs 19 of the respective first lead frame assembly 17. In line with the opposite ends of the ground coupling bars 29, 40 the housing comprises a further opening 43 (see FIG. 2).

Figure 5:
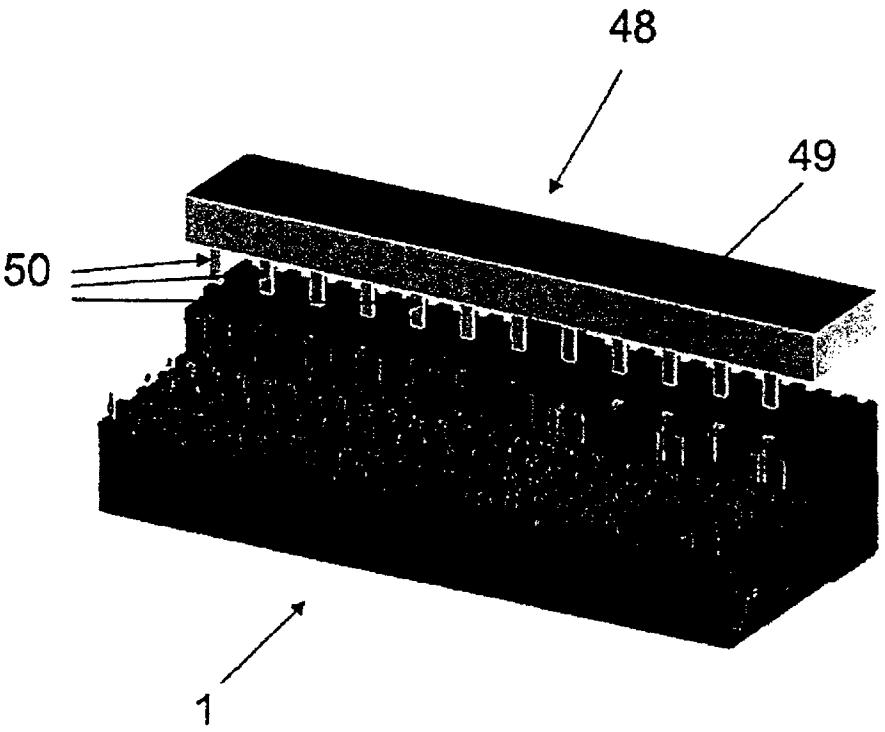
FIG. 5 shows an exemplary embodiment of a removal tool.

FIG. 5 shows a pressure tool 48 for removal of the ground coupling bars 29, 40. The pressure tool 48 comprises a main body 49 with a row of equidistantly arranged teeth 50. The teeth 50 fit into the openings 43 in the housing 6 near the lower ends of the ground coupling bars 29, 40. The distance between the teeth 50 corresponds to the distance between the openings 43. This way, the teeth 50 can be inserted in the openings 43 to push against the lower ends of the ground coupling bars 29, 40.

Figure 6:
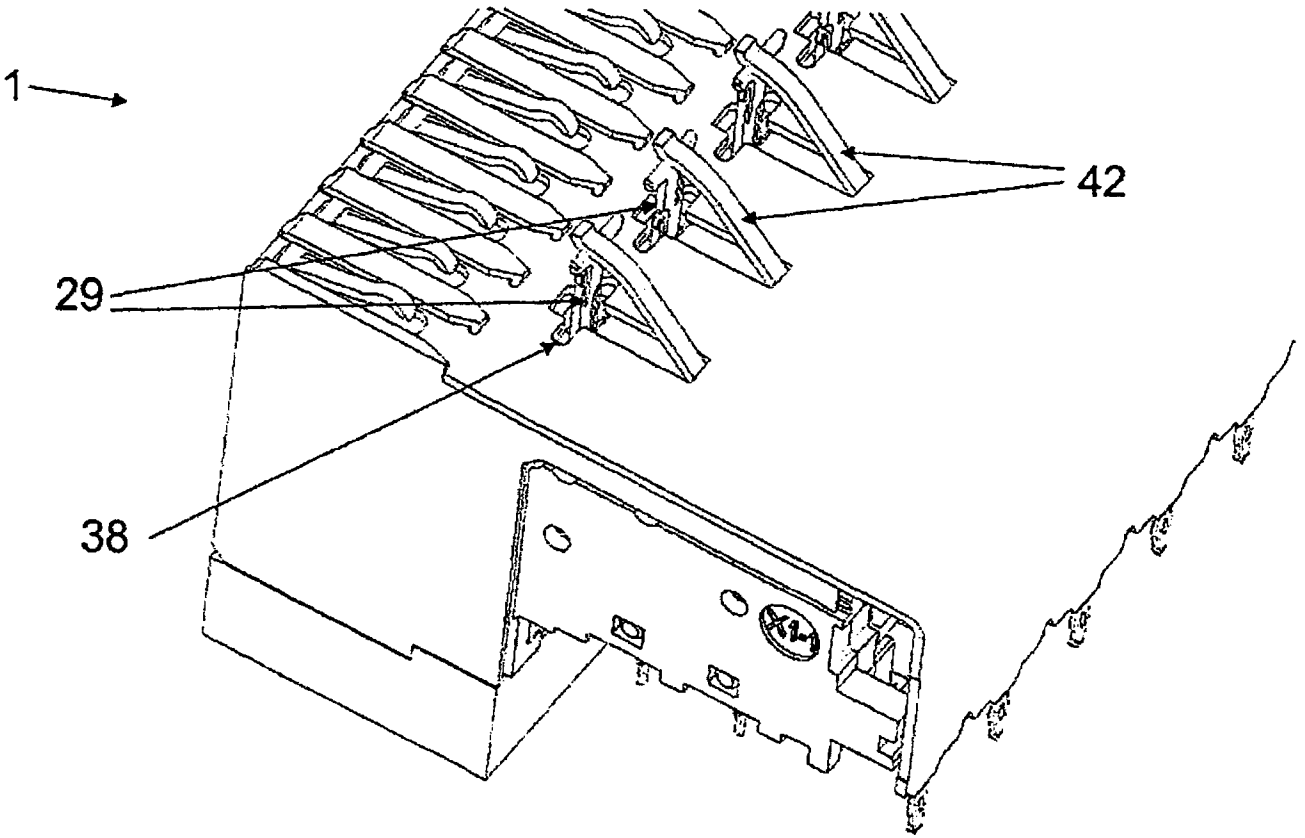
FIG. 6 shows the connector of FIGS. 1A and 1B during removal of the ground coupling bars.

FIG. 6 shows the connector 1 during removal of the ground coupling bars 29, 40. With the aid of the tool 48, the ground coupling bars 29, 40 are pushed against the action of the resilient blades of the ground shield 7 until they are out of the openings 37.

It should be noted that the illustrations and discussions of the embodiment shown in the figures are for exemplary purposes only, and should not be construed limiting the disclosure, e.g., references to directions such as "horizontal" or "vertical" only relate to the orientation of parts as shown in the figures unless stated otherwise. The skilled person will appreciate that several variations are comprised within the scope of the appended claims. Additionally, it should be understood that the concepts described above with the above-described embodiments may be employed alone or in combination with any of the other embodiments described above. It should be further appreciated that the various alternative embodiments described above with respect to one illustrated embodiment can apply to all embodiments as described herein, unless otherwise indicated.

It should further be noted that in the appended claims, the word "comprise" does not exclude other elements and the indefinite article "a" or "an" does not exclude a plurality.

The invention claimed is:

1. An electrical connector assembly comprising:

a connector assembly housing;

a plurality of electrical conductors within the connector assembly housing, wherein the electrical conductors include a plurality of signal conductors and a plurality of ground conductors;

at least one ground coupling bar, wherein the connector assembly housing comprises at least one slot enabling insertion of the ground coupling bar into the connector assembly housing from outside the connector assembly in a longitudinal direction of the ground coupling bar, wherein the at least one slot is positioned adjacent a line of conductors, wherein the ground coupling bar comprises contact portions for contacting at least a part of the conductors when inserted in the slot, wherein the conductors are arranged in modules carrying one or more lines of conductors having a first and second contact end and a lead frame portion extending between the first and second contact ends, wherein the connector assembly housing surrounds at least a portion of the modules, wherein the ground coupling bar is between the lead frame portion of a first module of the modules and the lead frame portion of a second module of the modules when the ground coupling bar is inserted in the slot.

2. The connector of claim 1 wherein the contact portions of the ground coupling bar are resilient members for resiliently engaging the ground conductors.

3. The connector of claim 2 wherein the resilient members are resilient fingers extending in a direction parallel to the longitudinal direction of the ground coupling bar, the resilient fingers having a free end engaging a respective ground conductor.

4. The connector according to claim 1 wherein the contact portions are positioned at opposite sides of the ground coupling bar.

5. The connector of claim 4 wherein the contact portions at one side of the ground coupling bar are arranged in a staggered manner with contact portions at the opposite side of the ground coupling bar.

6. The connector according to claim 1 wherein the ground coupling bar is provided with a shouldered top end.

7. The connector of claim 1, wherein the lead frame portion is embedded in an insulating material provided with a recess at least partly defining the ground coupling bar receiving slot, wherein in the recess the lead frame portions are at least partly uncovered by the insulating material allowing direct contact with the ground coupling bar.

8. The connector according to claim 1 wherein the housing is shielded by a ground shield contacting at least a part of the ground coupling bars.

9. The connector of claim 8 wherein the ground shield is provided with apertures allowing passage of the ground coupling bars.

10. The connector of claim 9 wherein the ground shield is provided with resilient members engaging the top ends of the ground coupling bars.

11. The connector of claim 10 wherein the resilient members are resilient blades at least partly crossing the slots in the ground shield.

12. An electrical connector assembly comprising:

a housing;

a plurality of electrical conductors within the housing, wherein the electrical conductors include a plurality of signal conductors and a plurality of ground conductors;

at least one ground coupling bar, wherein the housing comprises at least one slot enabling insertion of the ground coupling bar into the housing from outside in a longitudinal direction of the ground coupling bar, wherein the at least one slot is positioned adjacent a line of conductors, wherein the ground coupling bar comprises contact portions for contacting at least a part of the conductors when inserted in the slot, wherein the ground coupling bar and the slot are provided with matching polarization features to enable insertion in a single orientation.

13. An electrical connector assembly comprising:

a connector assembly housing;

a plurality of electrical conductors within the connector assembly housing, wherein the electrical conductors include a plurality of signal conductors and a plurality of ground conductors;

at least one ground coupling bar, wherein the connector assembly housing comprises at least one slot enabling insertion of the ground coupling bar into the connector assembly housing from outside the connector assembly in a longitudinal direction of the ground coupling bar, wherein the at least one slot is positioned adjacent a line of conductors, wherein the ground coupling bar comprises contact portions for contacting at least a part of the conductors when inserted in the slot, wherein the slot is accessible from outside the connector assembly from opposite ends, wherein the conductors are arranged in modules carrying one or more lines of conductors having a first and second contact end and a lead frame portion extending between the first and second contact ends, wherein the connector assembly housing surrounds at least a portion of the modules, wherein the ground coupling bar is between the lead frame portion of a first module of the modules and the lead frame portion of a second module of the modules when the ground coupling bar is inserted in the slot.

14. Tool mated to the connector of claim 13 for removal of one or more ground coupling bars comprising pressure elements insertable into the slots at one end of the respective ground coupling bars.

15. Method for assembling a connector comprising:

arranging modules within a connector assembly housing, wherein conductors, including a plurality of signal conductors and a plurality of ground conductors, are arranged in the modules carrying one or more lines of conductors having contacting ends and a lead frame portion extending between the contacting ends, wherein recesses in adjacent modules jointly define a ground coupling bar receiving slot, which is in line with an opening in the housing, wherein at least part of the conductors are at least partly uncovered in the recesses, and subsequently inserting a ground coupling bar into the ground coupling bar receiving slot via the corresponding opening in the housing, wherein the ground coupling bar is configured to contact one or more of the uncovered parts of the conductors, wherein the connector assembly housing surrounds at least a portion of the modules, wherein the ground coupling bar is between the lead frame portion of a first module of the modules and the lead frame portion of a second module of the modules when the ground coupling bar is inserted in the slot.

* * * * *